US011619050B2

(12) United States Patent
Young

(10) Patent No.: US 11,619,050 B2
(45) Date of Patent: Apr. 4, 2023

(54) RETURNED STAIR TREAD HAVING MOISTURE COMPENSATING JOINT AND METHOD FOR MAKING THE SAME

(71) Applicant: Robert Jeffrey Young, Beaver Dam, KY (US)

(72) Inventor: Robert Jeffrey Young, Beaver Dam, KY (US)

(73) Assignee: Young Manufacturing Company, Inc., Beaver Dam, KY (US)

( * ) Notice: Subject to any disclaimer, the term of this patent is extended or adjusted under 35 U.S.C. 154(b) by 0 days.

(21) Appl. No.: 17/362,016

(22) Filed: Jun. 29, 2021

(65) Prior Publication Data

US 2022/0003001 A1 Jan. 6, 2022

Related U.S. Application Data

(60) Provisional application No. 63/047,690, filed on Jul. 2, 2020.

(51) Int. Cl.
*E04F 11/108* (2006.01)
*E04F 11/104* (2006.01)

(52) U.S. Cl.
CPC ..... *E04F 11/108* (2013.01); *E04F 2011/1046* (2013.01)

(58) Field of Classification Search
CPC ... E04F 11/04; E04F 11/1042; E04F 11/1043; E04F 11/108; E04F 11/163; E04F 11/175; E04F 11/16; E04F 11/17; E04F 11/166; E04F 2011/1046; E04F 2011/1047
USPC ..... 52/179, 188
See application file for complete search history.

(56) References Cited

U.S. PATENT DOCUMENTS

| | | | | |
|---|---|---|---|---|
| 4,730,425 | A * | 3/1988 | Young | E04F 11/108 52/182 |
| 5,088,247 | A * | 2/1992 | Young | E04F 11/163 52/182 |
| 5,386,673 | A * | 2/1995 | Bellegarde | E04F 11/108 52/800.17 |
| 5,531,048 | A | 7/1996 | Darling | |
| 6,860,071 | B2 * | 3/2005 | Weaber | B27M 3/04 428/179 |
| 8,141,321 | B2 | 3/2012 | Young | |
| 8,316,594 | B2 | 11/2012 | Thompson | |
| 8,454,265 | B2 * | 6/2013 | Carroll | E04C 3/30 404/66 |
| 8,516,771 | B2 | 8/2013 | Mang, Sr. et al. | |

(Continued)

*Primary Examiner* — Kyle J. Walraed-Sullivan
(74) *Attorney, Agent, or Firm* — Calderon, Safran & Cole P.C.

(57) ABSTRACT

A returned stair tread assembly comprises a tread plate, a front nosing and a return nosing fitted flush against each other to form an exposed joint between the front and return nosings, and a device for securing the return nosing to the front nosing and the stair tread plate. The tread plate has a side tongue. The front nosing has a front nosing tongue spaced from a forward end of a side edge surface of the front nosing. The return nosing receiving the front nosing tongue of the front nosing and the side tongue of the stair tread plate therein. A front end of the side groove is spaced from a forward end of the return nosing. The front nosing tongue and the side tongue are disposed in the side groove and configured to slidably connect the stair tread plate and the return nosing.

19 Claims, 13 Drawing Sheets

(56) References Cited

U.S. PATENT DOCUMENTS

| | | | | |
|---|---|---|---|---|
| 8,745,937 | B1 | 6/2014 | Mang, Sr. et al. | |
| 9,920,536 | B2 | 3/2018 | Marhevka, Jr. | |
| 11,246,416 | B2 * | 2/2022 | Harris | B32B 21/02 |
| 2010/0287853 | A1 * | 11/2010 | Chung | E04F 11/16 52/179 |
| 2011/0179729 | A1 * | 7/2011 | Thompson | E04F 11/175 52/182 |
| 2011/0252725 | A1 * | 10/2011 | Giorgio | E04F 11/1045 52/177 |
| 2012/0180409 | A1 * | 7/2012 | Young | E04F 11/104 52/191 |
| 2013/0055666 | A1 * | 3/2013 | Lopez | E04F 11/175 52/179 |
| 2014/0373462 | A1 * | 12/2014 | Grenier | E04F 11/108 52/741.2 |

* cited by examiner

RETURNED STAIR TREAD HAVING MOISTURE COMPENSATING JOINT AND METHOD FOR MAKING THE SAME

CROSS-REFERENCE TO RELATED APPLICATIONS AND CLAIM TO PRIORITY

This application is related to provisional patent application No. 63/047,690, filed Jul. 2, 2020, in the United States of America, the disclosure of which is incorporated herein by reference and to which priority is claimed.

FIELD OF THE INVENTION

The present invention relates to returned stair treads in general and, more specifically, to returned stair treads having moisture compensated joints on one or both side edges that will not pull apart, gap or otherwise become deformed due to changes in ambient temperature and humidity, and methods for making the returned treads with such joints.

BACKGROUND OF THE INVENTION

Returned stair treads, generally speaking, have long been known and used. Typically, returned stair treads include a tread member constructed of wood with a return nosing affixed to a side edge of the tread, which forms an exposed joint along a forward side edge portion of the assembly. The return nosing is usually glued to the side edge of the tread member along the entire width of the tread member and, in addition, may be mechanically secured thereto at one or more positions, such as through nails.

A major problem that has been encountered with such construction is that the exposed joint may tend to gap open or otherwise become deformed when the returned stair tread is exposed to ambient temperature and humidity conditions beyond those encountered when the return nosing was originally affixed to the stair tread member. Such conditions are usually at their worst during late summer when returned treads are stored in non-airconditioned circumstances such as in a warehouse or building under construction. The gapping occurs because wood swells across the grain as it absorbs moisture, so the stair tread expands more than does the nosing and, thus, a gap between them is formed.

Many homes have a staircase made from plywood, oriented strand board (OSB), or other relatively inexpensive wood-based material, which is covered with carpet or other flooring material so that the underlying OSB, etc. is not visible. Consumers sometimes wish to refurbish the home and replace the original staircase with one that has a genuine wooden appearance. Replacing the original staircase is expensive, time consuming, and inconvenient because access between levels may be precluded until the project is completed.

A recent advance is a product known as "RetroTread®", which applies a relatively thin, wooden tread over the OSB tread. Because the wooden tread is thin, the staircase retains the original rise/fall of the OSB staircase. Should a standard thickness tread be used, the combination of the OSB and the wooden tread would be too thick, and walking on the staircase would not be natural and the staircase might not conform to local building codes. Thus, the thickness of the replacement wooden treads not exceed the thickness of the replaced carpet that had covered the OSB tread. Such refurbishment of staircases may also be required where the staircase has an exposed edge, which is also carpet covered to hide the unsightly appearance of the OSB, etc. If a thin RetroTread is to be used, then care must be takes to assure that the return nosing does not deform or gap and is maintained in position.

Therefore, the need exists to substantially overcome these difficulties encountered with prior art returned stair treads, particularly treads intended to be overlaid on an existing OSB, plywood, or the like staircase. Thus, improvements that may enhance performance and quality of returned stair treads constructed of wood with a return nosing are possible.

BRIEF SUMMARY OF THE INVENTION

According to a first aspect of the invention, a thin, returned stair tread assembly for use on an open portion of a stairway is provided. The returned stair tread assembly comprises a stair tread plate having a front edge surface and a side edge surface, a front nosing having a front edge surface, a rear edge surface and a side edge surface, the rear edge surface of the front nosing fitted flush against the side edge surface of the stair tread plate, a return nosing fitted flush against the side edge surfaces of the stair tread plate and the front nosing so as to form an exposed joint between the front nosing and the return nosing along the side edge surface of the front nosing and a front portion of the return nosing, and a securing device securing the return nosing to the front nosing and the stair tread plate only in a region including the exposed joint. The stair tread plate has a side tongue formed along the side edge surface of the stair tread plate. The front nosing has a front nosing tongue formed along a portion of the side edge surface. The return nosing has a side groove formed along a portion of an inner surface of the return nosing and receiving the front nosing tongue of the front nosing and the side tongue of the stair tread plate. The front nosing tongue and the side tongue are disposed in the side groove and slidably connect the stair tread plate and the return nosing along at least rear portions of the return nosing. The front nosing is secured to the return nosing, such as by suitable adhesive. The return nosing is secured to the stair tread plate at a forward portion of the tread plate, such as by a mechanical fastener.

According to a second aspect of the invention, a method for making a thin returned stair tread assembly for use on an open stairway or an open portion of a stairway is provided. The method comprises the steps of providing a stair tread plate made of wood and having a front edge surface and a side edge surface, providing a front nosing formed separately from the stair tread plate and having a front edge surface, a rear edge surface and a side edge surface, and providing a return nosing having a side groove formed along a portion but not an entire length of an inner surface of the return nosing. The front nosing has a rear groove formed along the rear edge surface of the front nosing. A front end of the side groove is spaced from a forward end of the return nosing. The side groove has a forward portion formed in a front portion of the inner surface of the return nosing and a rearward portion formed in a rear portion of the inner surface of the return nosing. The method for making the returned stair tread assembly further comprises the steps of attaching the front nosing to the stair tread plate so that the rear edge surface of the front nosing fits flush against the front edge surface of the stair tread plate, forming a side tongue along the side edge surface of the stair tread plate and a front nosing tongue along a portion but not the entire length the side edge surface of the front nosing so that the front nosing tongue is spaced from a forward end of the side edge surface of the front nosing, and mounting the return nosing to the front nosing and the stair tread plate by inserting the front nosing tongue of the front nosing into the forward portion of the side groove of the return nosing and the side tongue of the stair tread plate into the rearward portion of the side groove of the return nosing to form an exposed joint between the side edge surface of the front nosing and the front portion of the inner surface of the return nosing. The side tongue of the stair tread plate and the rearward portion of the side groove of the return nosing are slidably connected to one another along at least rear portions thereof rearward of the exposed joint. Also, the method comprises the step of securing, such as with a mechanical fastener, the return nosing to the front nosing and the stair tread plate only along a region including the exposed joint to prevent significant gapping or other deformation of the exposed joint as the result of expansion or contraction of the stair tread plate over a range of ambient temperature and humidity.

Other aspects of the invention, including devices, systems, processes, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS

Figure 1:
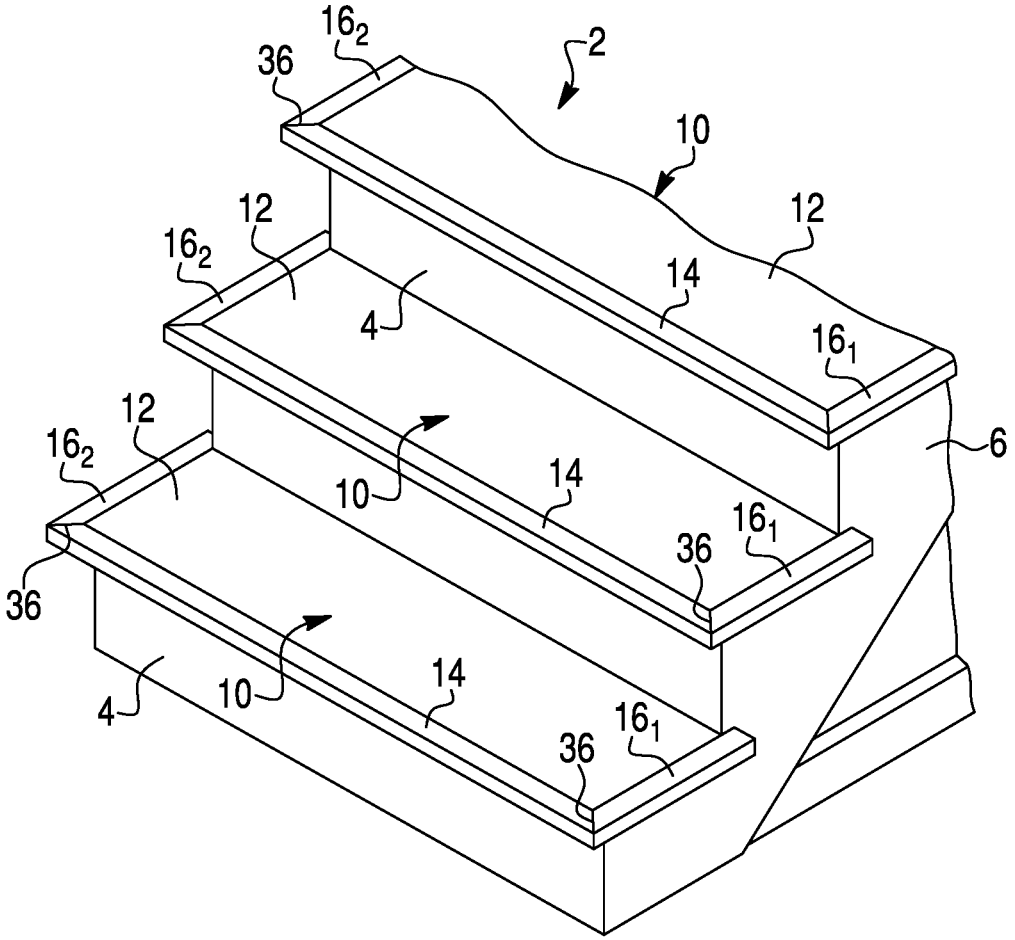
FIG. 1 is a perspective view of a portion of an open stairway having returned stair tread assemblies according to an exemplary embodiment of the present invention.

Reference will now be made in detail to the exemplary embodiments and exemplary methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and exemplary methods.

This description of exemplary embodiments is intended to be read in connection with the accompanying drawings, which are to be considered part of the entire written description. In the description, relative terms such as "horizontal," "vertical," "front," "rear," "upper", "lower", "top" and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. Additionally, the word "a" and "an" as used in the claims means "at least one" and the word "two" as used in the claims means "at least two".

FIG. 1 shows an open stairway 2 having risers 4, wooden returned stair tread assemblies 10 according to an exemplary embodiment of the present invention, and a stringer 6 on the open side or sides thereof. The risers 4 and the returned stair tread assemblies 10 are usually of selected height and width, respectively, to meet building code requirements.

A front edge portion of each of the returned stair tread assemblies 10 rests upon and extends forwardly beyond a different one of the risers 4 in overlapping relationship therewith. Side edge portions of each of the returned stair tread assemblies 10 rest upon a different horizontally extending upper edge of the stringers 6, only one of which is shown in FIG. 1. Those skilled in the art recognize that there is a stringer on each side edge of the stairway 2.

Figure 2:
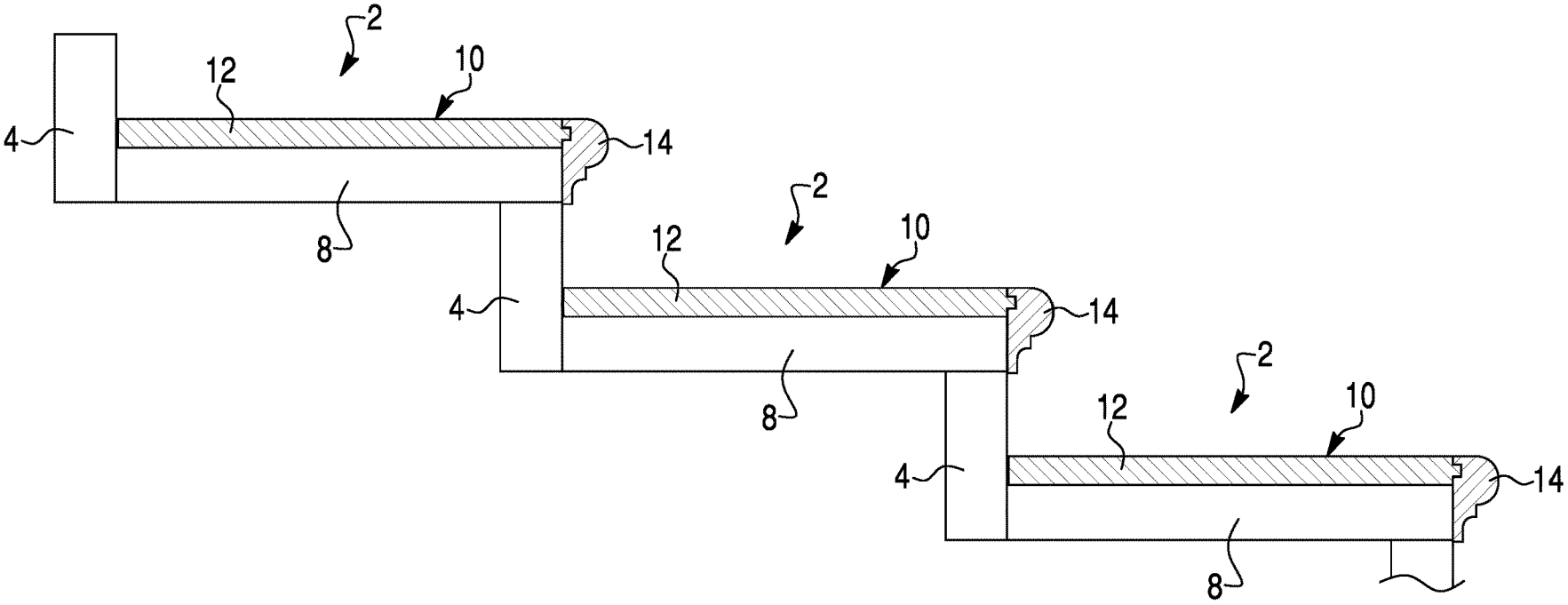
FIG. 2 is a sectional view of an existing stairway reconditioned with the returned stair tread assemblies according to the exemplary embodiment of the present invention.
Figure 3:
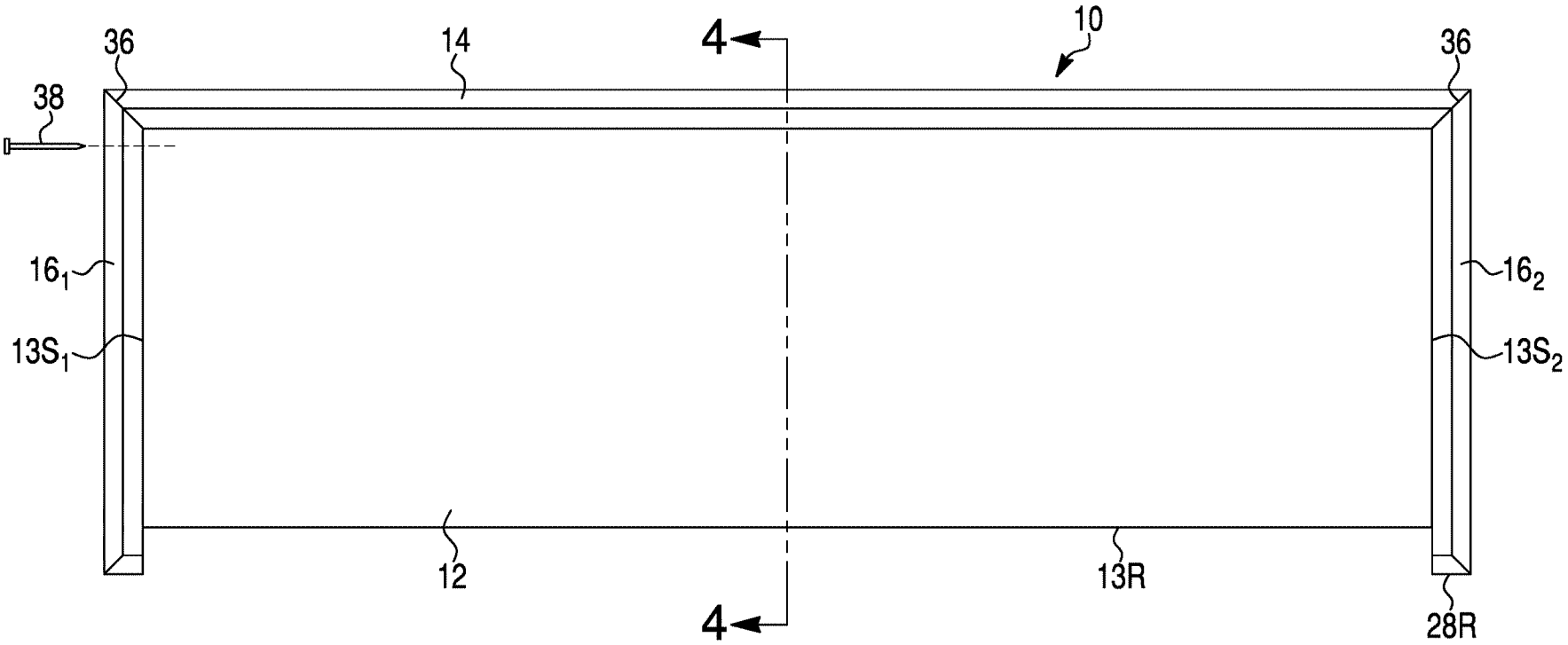
FIG. 3 is a top view of the returned stair tread assembly according to an exemplary embodiment of the present invention.
Figure 4:
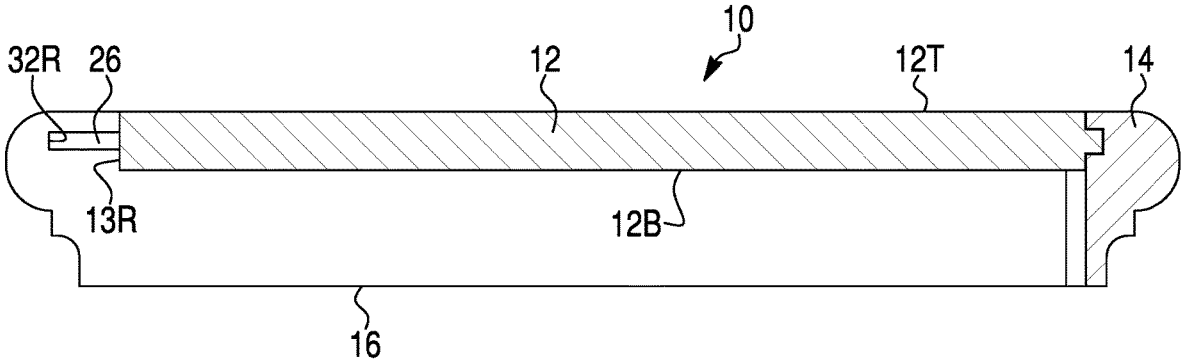
FIG. 4 is a sectional view of the returned stair tread assembly taken along the line 4-4 in FIG. 3.
Figure 5:
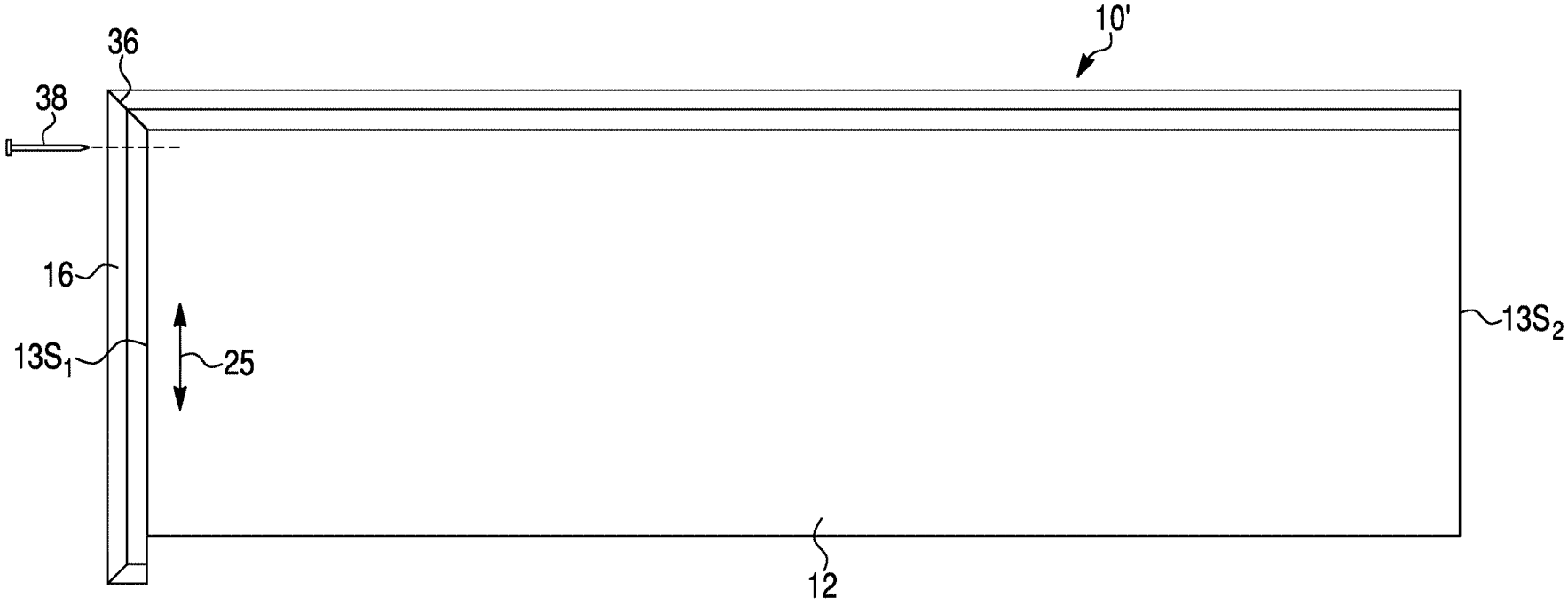
FIG. 5 is a top view of the returned stair tread according to an alternative embodiment of the present invention.

As illustrated in FIGS. 1 and 2, the returned stair tread assemblies 10 of the stairway 2 are typically structurally and geometrically identical. Each of the returned stair tread assemblies 10, as best illustrated in FIGS. 3 and 4, comprises a stair tread plate 12, a front nosing (or front tread nosing) 14, and right and left (or first and second) return nosings (or side nosings) $\mathbf{16}_1$ and $\mathbf{16}_2$, respectively, connected to corresponding right and left (or first and second) side edge surfaces $\mathbf{13}S_1$ and $\mathbf{13}S_2$, respectively, of each of the stair tread plates 12. Each of the stair tread plates 12 is nominally ⅝-¾ inches thick, and preferably made of solid wood, such as oak. Conventional tread plates are typically about 1 inch to about 1 1/16 inch thick. The thickness of the stair tread plates 12 is thus considerably less than the thickness of standard stair tread plates. Further according to the exemplary embodiments, all parts of each of the returned stair tread assemblies 10, i.e., the stair tread plate 12, the front nosing 14 and the side return nosings $\mathbf{16}_1$ and $\mathbf{16}_2$ are made of wood, preferably solid wood, such as oak. While FIGS. 1-4 illustrate the return tread assembly 10 as having return nosings $\mathbf{16}_1$ and $\mathbf{16}_2$ on the opposed ends of tread plate 12, alternatively, returned stair tread assemblies, such as a returned stair tread assembly 10', as best shown in FIG. 5, may comprise only one of the side return nosings $\mathbf{16}_1$ or $\mathbf{16}_2$ connected to one of the side edge surfaces $\mathbf{13}S_1$ or $\mathbf{13}S_2$, respectively, of at least one of the stair tread plates 12.

The stair tread plate 12, the front nosing 14 and the return nosing 16 are connected to each other by a tongue and groove type of connection configured to permit the stair tread plate 12 and the return nosing 16 to move relative to each other as the stair tread plate 12 expands due to changes in ambient conditions.

The right and left side edge surfaces $\mathbf{13}S_1$ and $\mathbf{13}S_2$ of each of the stair tread plates 12 are geometrically identical. In view of this similarity of the right and left side edge surfaces $\mathbf{13}S_1$ and $\mathbf{13}S_2$, and in the interest of simplicity, the following discussion will sometimes use a reference numeral without a subscript numeral to designate an entire group of substantially identical structures. For example, the reference numeral 13S will be used when generically referring to each of the right and left side edge surfaces $\mathbf{13}S_1$ and $\mathbf{13}S_2$, rather than reciting two reference numerals. Similarly, according to the exemplary embodiment, the right and left return nosings $\mathbf{16}_1$ and $\mathbf{16}_2$ of each of the returned stair treads 10 of the stairway 2 are structurally identical. In view of these structural similarities of the right and left return nosings $\mathbf{16}_1$ and $\mathbf{16}_2$, and in the interest of simplicity, the following discussion will sometimes use a reference numeral without a subscript numeral to designate an entire group of substantially identical structures. For example, the reference numeral 16 will be used when generically referring to each of the right and left return nosings $\mathbf{16}_1$ and $\mathbf{16}_2$ rather than reciting two reference numerals. Alternatively, the right and left return nosings $\mathbf{16}_1$ and $\mathbf{16}_2$ of each of the returned stair treads 10 of the stairway 2 may be structurally different.

Figure 6:
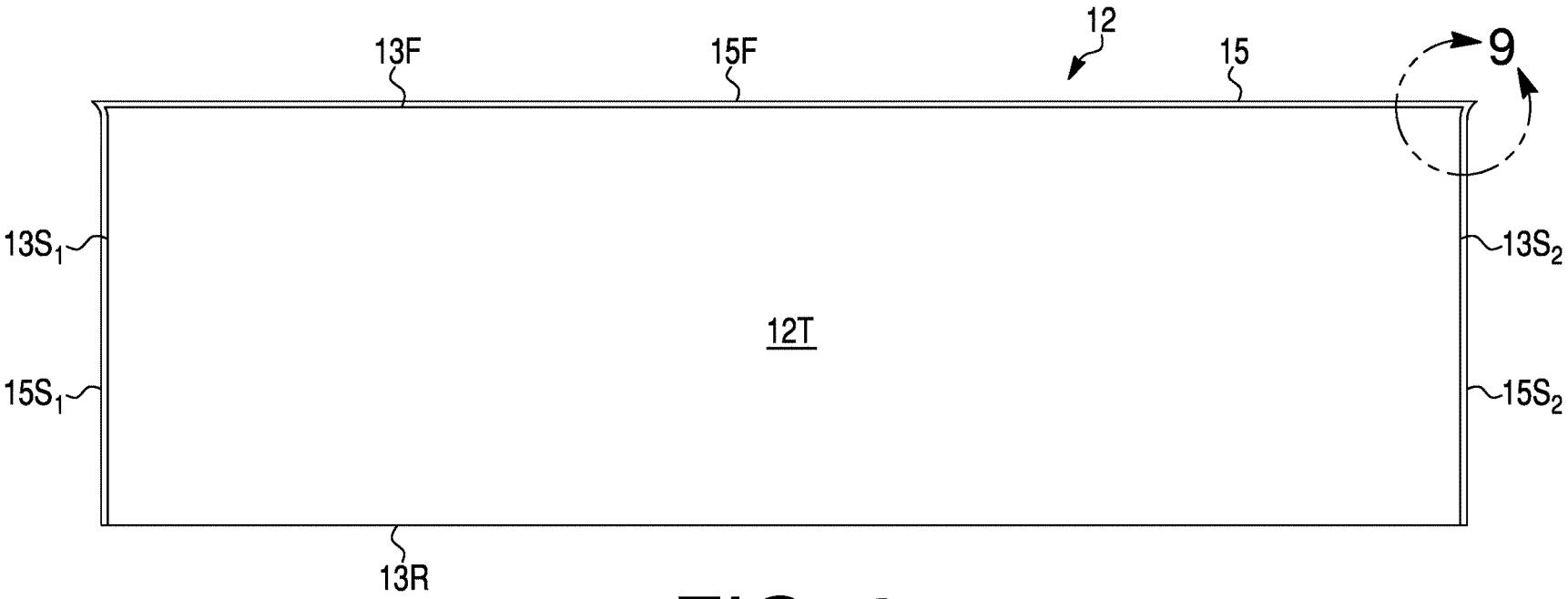
FIG. 6 is a top view of a stair tread plate of the returned stair tread assembly according to the exemplary embodiment of the present invention.
Figure 7:
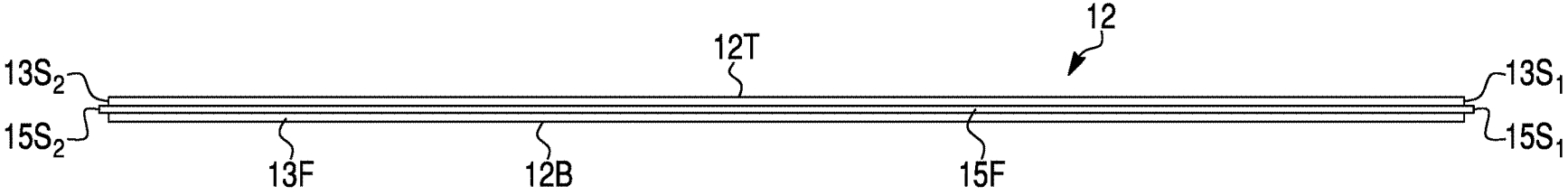
FIG. 7 is a front view of the stair tread plate of the returned stair tread assembly according to the exemplary embodiment of the present invention.
Figure 8:
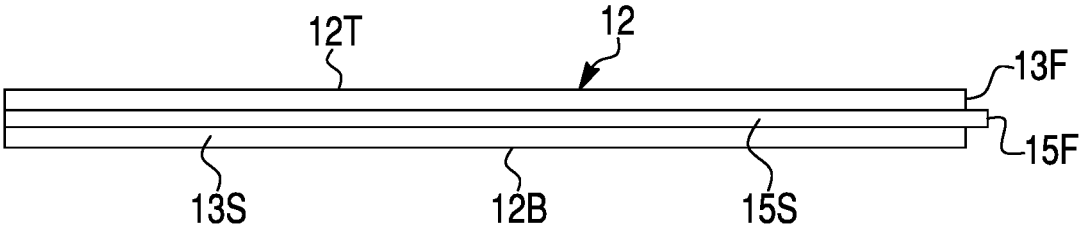
FIG. 8 is a side view of the stair tread plate of the returned stair tread assembly according to the exemplary embodiment of the present invention.
Figure 9:
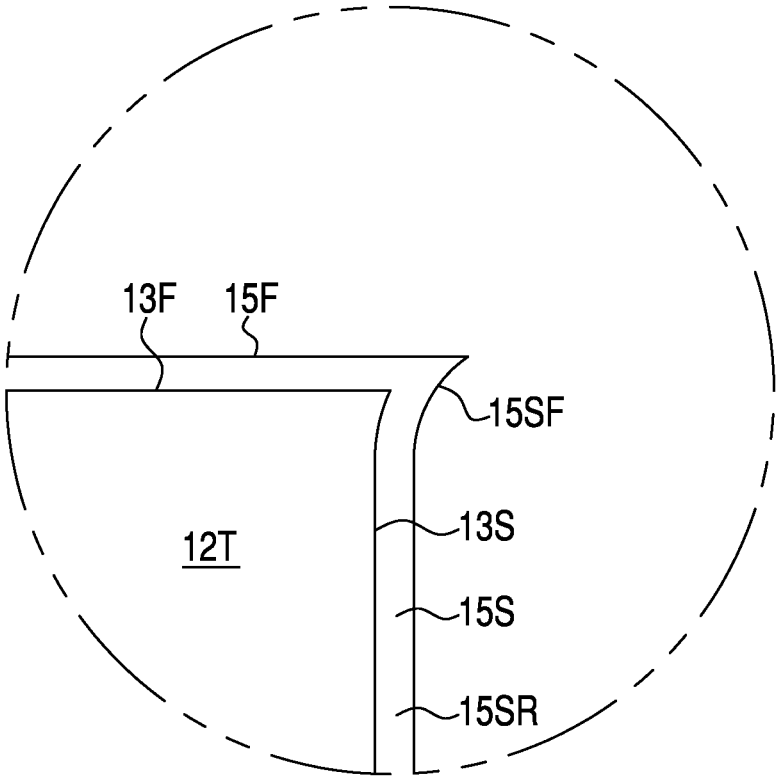
FIG. 9 is an enlarged view of a fragment of the stair tread plate shown in the circle "9" of FIG. 6.
Figure 10:
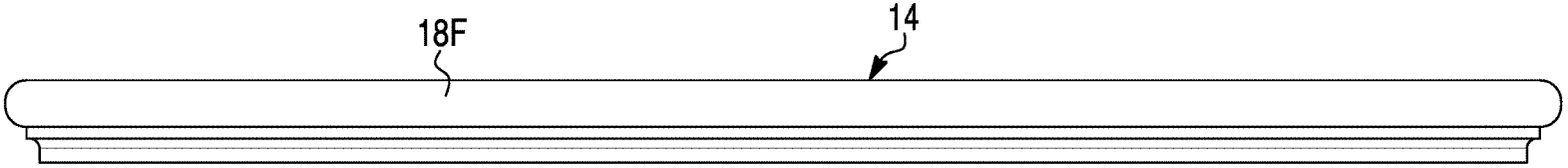
FIG. 10 is a front view of a front nosing of the returned stair tread assembly according to the exemplary embodiment of the present invention.

As further shown in FIGS. 7-9, the stair tread plate 12 has a front edge surface 13F and a rear edge surface 13R between the side edge surfaces $\mathbf{13}S_1$ and $\mathbf{13}S_2$. The stair tread plate 12 has a first side tongue $\mathbf{15}S_1$ extending from the rear edge surface 13R of the stair tread plate 12 to the front edge surface 13F thereof, i.e., along an entire length of the first side edge surface $\mathbf{13}S_1$, a second side tongue $\mathbf{15}S_2$ extending from the rear edge surface 13R of the stair tread plate 12 to the front edge surface 13F thereof, i.e., along an entire length of the second side edge surface $\mathbf{13}S_2$, and a front tongue 15F extending along an entire length of the front edge surface 13F of the stair tread plate 12. The side tongues $\mathbf{15}S_1$ and $\mathbf{15}S_2$ and the front tongue 15F of the stair tread plate 12 are formed unitarily with the stair tread plate 12, such as by milling or other machining. The first and second side tongues $\mathbf{15}S_1$, $\mathbf{15}S_2$ and the front tongue 15F form a continuous tread plate tongue 15 that runs the side edge surfaces $\mathbf{13}S_1$ and $\mathbf{13}S_2$ and the front edge surface 13F of the stair tread plate 12 continuously (i.e., without interruption), as best shown in FIG. 6. As best shown in FIG. 9, each of the side tongues $\mathbf{15}S_1$ and $\mathbf{15}S_2$ is machined to form a contoured (i.e., curved) front portion 15SF and a straight rear portion 15SR.

The first and second side tongues $\mathbf{15}S_1$ and $\mathbf{15}S_2$ of each of the stair tread plates 12 are geometrically identical. In view of this similarity of the first and second side tongues $\mathbf{15}S_1$ and $\mathbf{15}S_2$, and in the interest of simplicity, the following discussion will sometimes use a reference numeral without a subscript numeral to designate an entire group of substantially identical structures. For example, the reference numeral 15S will be used when generically referring to each of the first and second side tongues $\mathbf{15}S_1$ and $\mathbf{15}S_2$, rather than reciting two reference numerals.

As best shown in FIGS. 10-14, the front nosing 14 has a contoured front edge surface 18F, a rear edge surface 18R, and right and left (or first and second) opposite side edge surfaces $\mathbf{18}S_1$ and $\mathbf{18}S_2$, respectively, extending between the front edge surface 18F and the rear edge surface 18R at an oblique angle (i.e., an angle more than 0° and less than 90°) relative to the front edge surface 18F, preferably at 45°, or obtusely extends from the rear edge surface 18R of the front nosing 14. The right and left side edge surfaces $\mathbf{18}S_1$ and $\mathbf{18}S_2$ of each of the front nosings 14 are geometrically identical. In view of this similarity of the right and left side edge surfaces $\mathbf{18}S_1$ and $\mathbf{18}S_2$, and in the interest of simplicity, the following discussion will sometimes use a reference numeral without a subscript numeral to designate an entire group of substantially identical structures. For example, the reference numeral 18S will be used when generically referring to each of the right and left side edge surfaces $\mathbf{18}S_1$ and $\mathbf{18}S_2$, rather than reciting two reference numerals.

Figure 11:
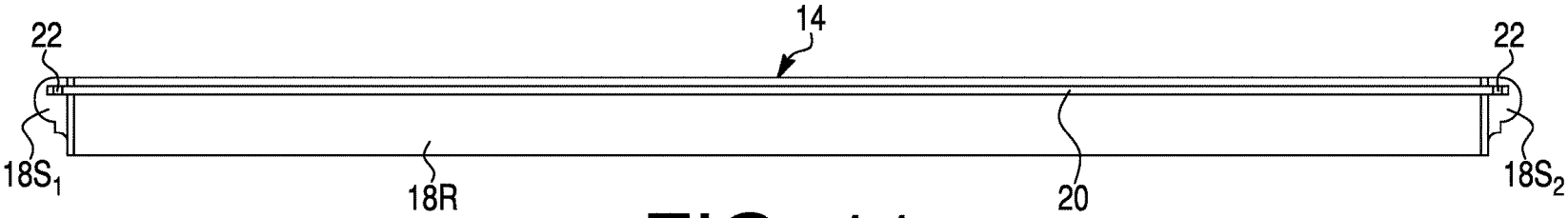
FIG. 11 is a rear view of the front nosing of the returned stair tread assembly according to the exemplary embodiment of the present invention.
Figure 12:
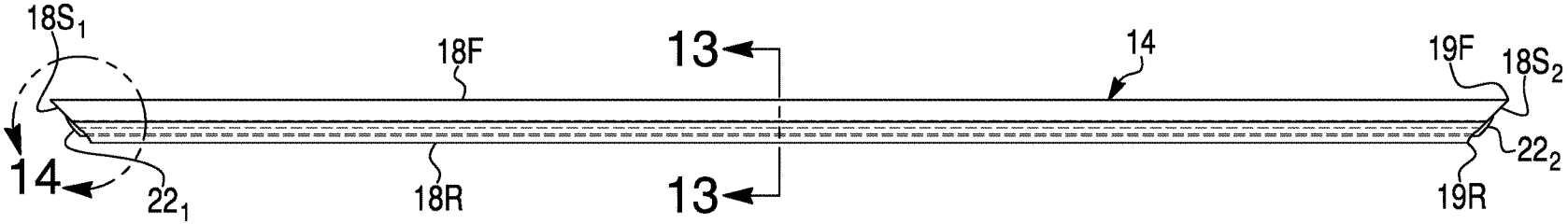
FIG. 12 is a top view of the front nosing of the returned stair tread assembly according to the exemplary embodiment of the present invention.
Figure 13:
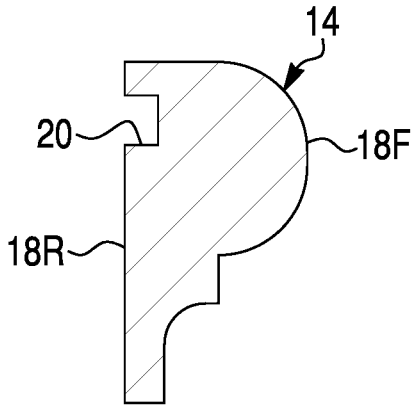
FIG. 13 is a sectional view of the front nosing taken along the line 13-13 in FIG. 12.

As further shown in FIGS. 11-13, the front nosing 14 has a rear groove 20 extending along the entire length of the rear edge surface 18R of the front nosing 14. The rear groove 20 is configured to receive the front tongue 15F of the stair tread plate 12. The front tongue 15F of the stair tread plate 12 is disposed in the rear groove 20 of the front nosing 14, thus connecting the front nosing 14 to the stair tread plate 12. As explained further, the front nosing 14 is adhesively secured to tread plate 12 through the front tongue 15F received in the rear groove 20. The front tongue 15F and the rear groove 20 are preferably rectangular in shape so that the front tread 14 engages the front tongue 15F in order to provide mechanical support that supplements the adhesive connection.

Figure 14:
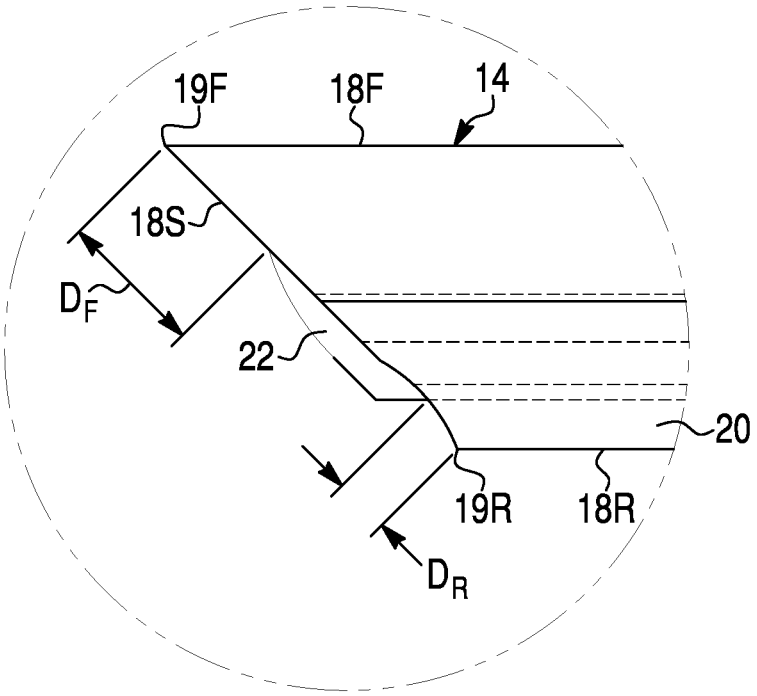
FIG. 14 is an enlarged view of a fragment of the front nosing shown in the circle "14" in FIG. 12.
Figure 15:
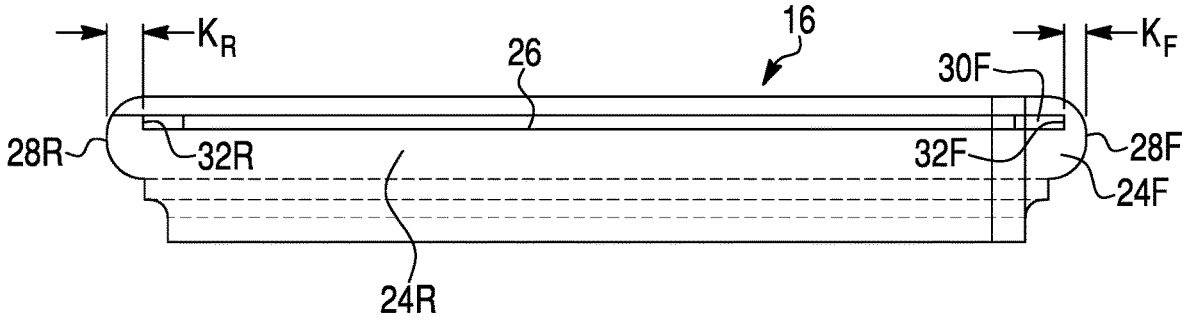
FIG. 15 is a rear view of a return nosing of the returned stair tread assembly according to the exemplary embodiment of the present invention.
Figure 16:
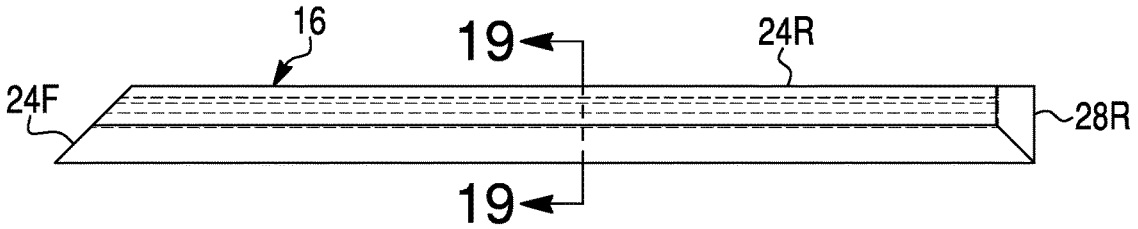
FIG. 16 is a top view of the return nosing of the returned stair tread assembly according to the exemplary embodiment of the present invention.
Figure 17:
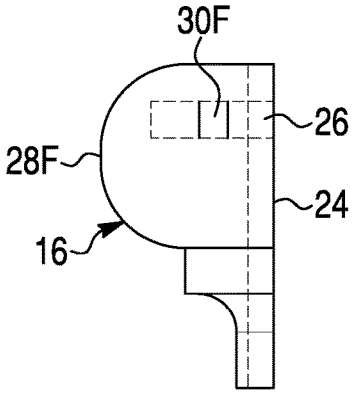
FIG. 17 is a side view with portions shown in phantom of the return nosing of the returned stair tread assembly according to the exemplary embodiment of the present invention.
Figure 19:
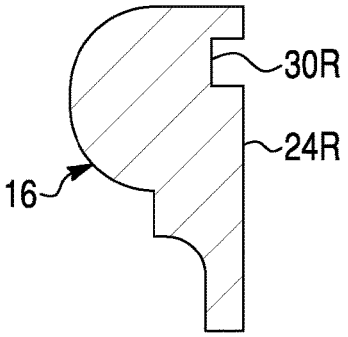
FIG. 19 is a sectional view of the return nosing taken along the line 19-19 in FIG. 16.
Figure 18:
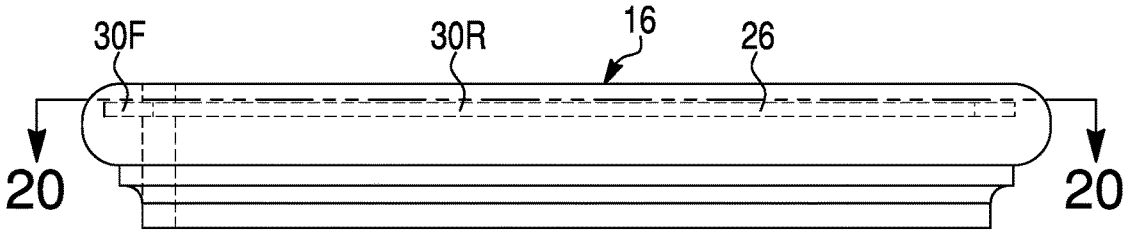
FIG. 18 is a front view of the return nosing of the returned stair tread assembly according to the exemplary embodiment of the present invention.

Also, the front nosing 14 is provided with first and second front nosing tongues $\mathbf{22}_1$ and $\mathbf{22}_2$ formed unitarily, such as by milling, on each of the first and second side edge surfaces 18$S_1$ and 18$S_2$, respectively. The first and second front nosing tongues 22$_1$ and 22$_2$ of each of the front nosings 14 are geometrically identical. In view of this similarity of the first and second front nosing tongues 22$_1$ and 22$_2$, and in the interest of simplicity, the following discussion will sometimes use a reference numeral without a subscript numeral to designate an entire group of substantially identical structures. For example, the reference numeral 22 will be used when generically referring to each of the first and second front nosing tongues 22$_1$ and 22$_2$, rather than reciting two reference numerals. As best shown in FIG. 14, each of the front nosing tongues 22 is formed along a portion of one of the side edge surfaces 18S of the front nosing 14. Specifically, as best shown in FIGS. 12 and 14, each of the front nosing tongues 22 is spaced from a forward end 19F of the side edge surface 18S (or from the front edge surface 18F) of the front nosing 14 on a distance $D_F$ and from a rearward end 19R of the side edge surface 18S (or from the rear edge surface 18R) of the front nosing 14 on a distance $D_R$.

As best shown in FIGS. 15-20, each of the return nosings 16 has an inner surface 24 extending between a forward end 28F and a rearward end 28R of the return nosing 16, and a side groove 26 formed, such as by cutting with a router, along a portion (but not the entire length) of the inner surface 24 of the return nosing 16 for receiving the front nosing tongue 22 of the front nosing 14 and the side tongue 15S of the tread plate 12 therein, as best shown in FIGS. 3 and 4. As best shown in FIGS. 17, 19, 20 and 21, the inner surface 24 of the side nosing 16 has a contoured front portion 24F and a rear portion 24R. The front portion 24F of the inner surface 24 of the side nosing 16 extends at an oblique angle relative to the rear portion 24R, preferably at 45°, in order to match the contour of the surface 18F. Moreover, the rearward end 28R of the side nosing 16 extends behind the corresponding riser 4 along and flush with the stringer 6 for short distances, as best shown in FIGS. 1 and 3. FIG. 1 shows conventional portions of the stair tread plate 12 and the return nosing 16 as they would appear on an open stairway in a fully assembled state.

Figure 20:
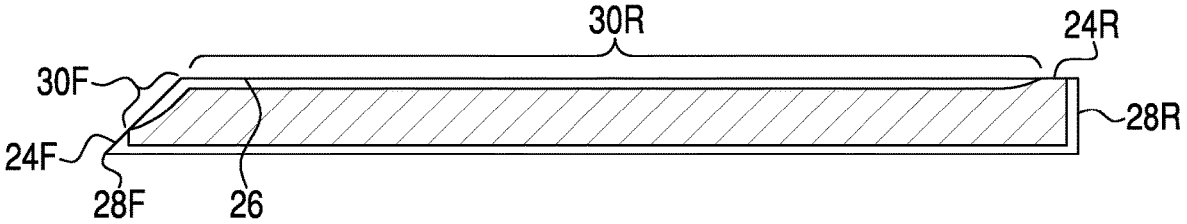
FIG. 20 is a sectional view of the return nosing taken along the line 20-20 in FIG. 18.
Figure 21:
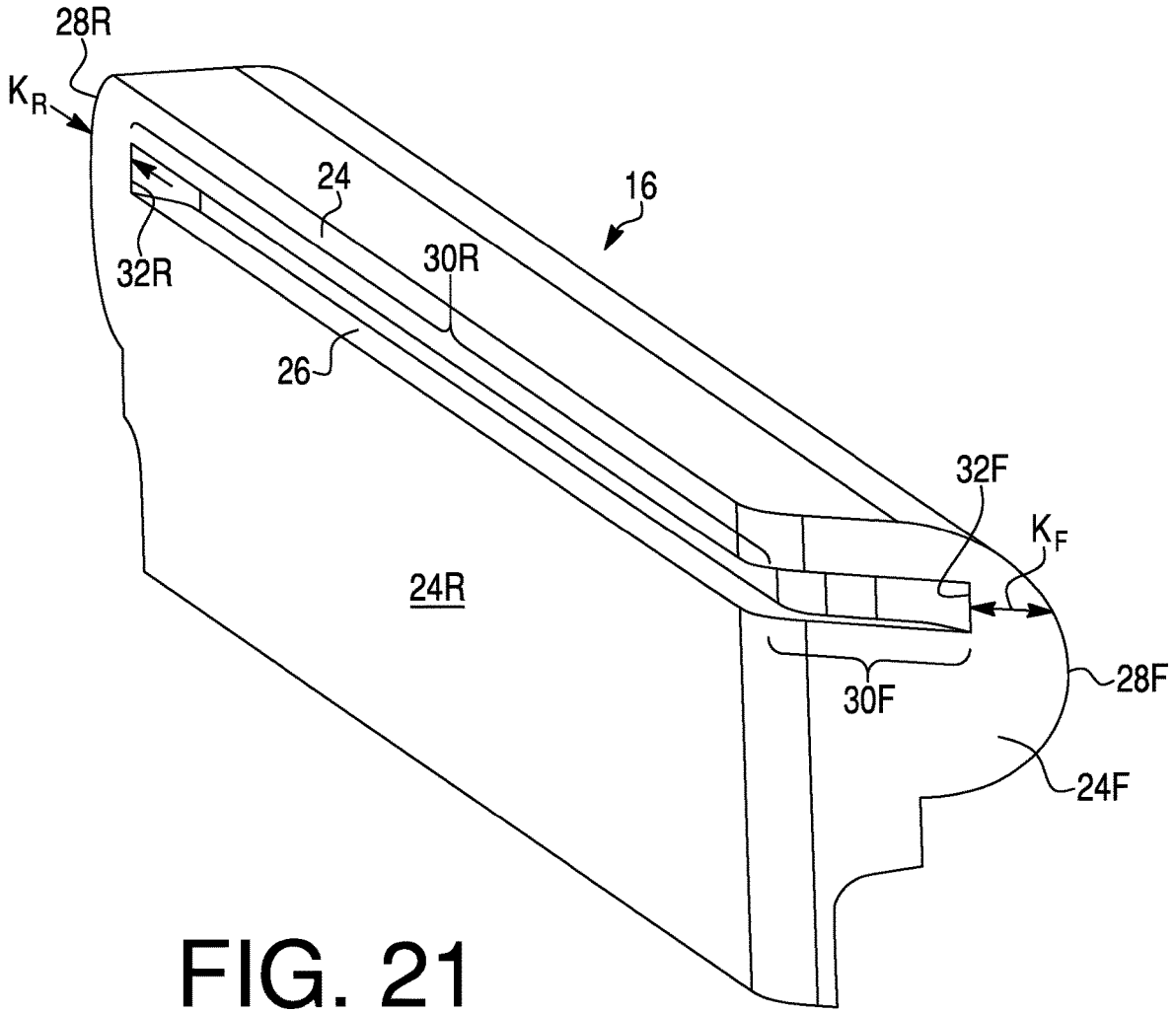
FIG. 21 is a perspective view of the return nosing of the returned stair tread assembly according to the exemplary embodiment of the present invention.

As further illustrated in FIGS. 16, 17, 19, 20 and 21, the side groove 26 extends between the forward end 28F and the rearward end 28R of the return nosing 16. As best shown in FIGS. 20 and 21, the side groove 26 has a forward portion 30F formed in the front portion 24F of the inner surface 24 of the return nosing 16, and a rearward portion 30R formed in the rear portion 24R of the inner surface 24 of the return nosing 16. Furthermore, the side groove 26 has an open front end 32F and a closed rear end 32R. Moreover, as best shown in FIG. 21, the front end 32F of the side groove 26 is longitudinally spaced from the forward end 28F of the return nosing 16 a distance $K_F$, while the rear end 32R of the side groove 26 is longitudinally spaced from the rearward end 28R of the return nosing 16 a distance $K_R$. Accordingly, the side groove 26 extends from the rearward end 28R of the inner surface 24 of the return nosing 16 along a portion (but not the entire length) of the return nosing 16. The side groove 26 extends from the forward end 28F of the return nosing 16 to a position about an inch behind the rear edge surface 13R and the side tongue 15S of the stair tread plate 12, and terminates short of the rearward end 28R of the return nosing 16. While the side groove 26 could be formed all the way to the rearward end 28R of the return nosing 16 with a rear open end, stopping the side groove 26 short of the rearward end 28R of the return nosing 16, as shown in FIGS. 20 and 21, assures that the rear end 32R of the side groove 26 will not be visible from behind the return nosing 16 so as to possibly cause an unsightly appearance.

The side tongue 15S of the stair tread plate 12 and the front nosing tongue(s) 22 of the front nosing 14 are configured to match the side groove 26 in the return nosing 16. The side groove 26 has a shape and size that assures a good blend line with the stair tread plate 12. Specifically, one of the front nosing tongues 22 of the front nosing 14 is received in the forward portion 30F of the side groove 26, while the side tongue 15S of the stair tread plate 12 is received in the rearward portion 30R and partially in the forward portion 30F of the side groove 26 of the return nosing 16. Specifically, the contoured front portion 15SF of the side tongues 15S is disposed in the forward portion 30F of the side groove 26, while the straight rear portion 15SR is disposed in the rearward portion 30R of the side groove 26. The contoured front portion 15SF of the side tongues 15S disposed in the forward portion 30F of the side groove 26 provides additional mechanical support when someone steps on the side nosing 16.

As best shown in FIGS. 1 and 5, the front nosing 14 and the corresponding side nosing 16 form a straight exposed joint 36 between the side edge surface 18S of the front nosing 14 and the juxtaposed front portion 24F of the inner surface 24 of the return nosing 16. Moreover, the front nosing tongue 22 of the front nosing 14 extends from the side edge surface 18S of the front nosing 14 along a portion of the mitered exposed joint 36. More specifically, the exposed joint 36 is formed between the adjoining pair of the side edge surface 18S and the front portion 24F of the inner surface 24 of the front nosing 14 and the stair tread plate 12, respectively, which is of the well-known mitered type.

A suitable wood glue or other adhesive such as, for example, polyvinyl acetate, is applied to the side edge surface 18S of the front nosing 14 or the opposing front portion 24F of the inner surface 24 of the return nosing 16 in the area of the exposed joint 36 to provide a securing device, which secures the front nosing 14 to the return nosing 16 only in a region including the exposed joint 36. Because the nosing 16 is secured only to the front of the tread assembly 10 and thus the tongues slide within grooves 26, gapping or other deformation of the exposed joint 36 as the stair tread plate 12 is prevented as the tread plate 12 expands or contracts in width due to changing ambient temperature and humidity conditions. Additionally, a single mechanical fastener, such as a single finishing nail 38 (best shown in FIGS. 3 and 5) or other suitable mechanical fastener, such as a screw, wooden dowel pin or the like, may be driven through the side nosing 16 into the side edge surface 13S of the stair tread plate 12, preferably through flat portions of the tongue 15S and the groove 26 just rearward of the exposed joint 36. The nail 38 may be located in a region immediately rearward of and next to a rearward edge of the exposed joint 36, as best shown in FIGS. 3 and 5, such that no significant gapping or deformation will occur in the exposed joint 36 even with substantial expansion and contraction of the width of the stair tread plate 12 over a range due to changes in ambient temperature and humidity. Moreover, the nail 38 is positioned no more than about three (3) inches from the front edge surface 18F of the front nosing 14 and the glue applied to the exposed joint 36 does not extend rearward of the exposed joint 36 beyond the nail 38.

Because the wood grain of the stair tread plate 12 extends generally across its width from one end to the other, 13$S_1$, 13$S_2$, expansion and contraction of the stair tread plate 12 will occur in the directions indicated by double-headed arrow 25, best shown in FIGS. 3 and 5. As the stair tread plate 12 expands and contracts, the side tongue 15S of the tread plate 12 may slide along the groove 26 of the return nosing 16 along their adjoining surfaces, except at the position of the nail 38 and along the glued exposed joint 36. Because the nail 38 is located close to the exposed joint 36, the nail 38 lies within the region where little if any expansion or contraction will occur, such that no unsightly gap or other deformation will occur in the exposed joint 36 even where the stair tread plate 12 is exposed to relatively wide temperature and humidity variations and even where no glue or adhesive is used in the exposed joint 36. Thus, while it is preferable to use both glue in the exposed joint 36 and a suitable mechanical fastener (such as the nail 38) to fasten the return nosing 16 to the stair tread plate 12, the latter two elements can be adequately secured together either by using glue in the exposed joint 36, without using a mechanical fastener, or by using the fastener without gluing the exposed joint 36.

The left-side edge surface 13$S_2$ of the stair tread plate 12 is structurally and geometrically identical to the right-side edge surface 13$S_1$ of the stair tread plate 12, and the second side tongue 15$S_2$ is identical to the first side tongue 15$S_1$ formed along the left-side edge surface 13$S_2$ of the stair tread plate 12 in those situations where the staircase 2 is open on both sides. In situations where the staircase 2 is open or exposed only on one side, there is a side nosing only along the exposed edge surface 13S of the stair tread plate 12.

A method for making the returned stair tread assembly 10 according to the exemplary embodiment is as follows.

First, the stair tread plate 12, the front nosing 14 formed separately from the stair tread plate 12, and one or two the return nosings 16, all made of the solid wood, are provided.

Initially, the stair tread plate 12 has a rectangular shape and is formed only with the front tongue 15F extending along the entire length of the front edge surface 13F of the stair tread plate 12 (without the side tongue(s) 15S). Similarly, the front nosing 14 is formed only with the rear groove 20 extending along the entire length of the rear edge surface 18R of the front nosing 14 (without the front nosing tongue(s) 22).

Figure 22:
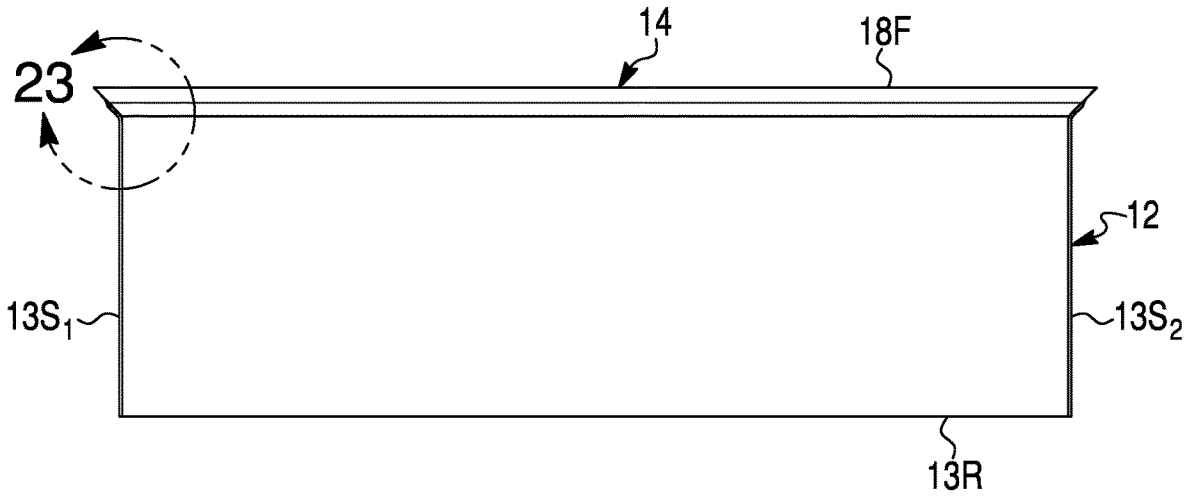
FIG. 22 is a top view of the front nosing attached to the stair tread plate according to the exemplary embodiment of the present invention.
Figure 23:
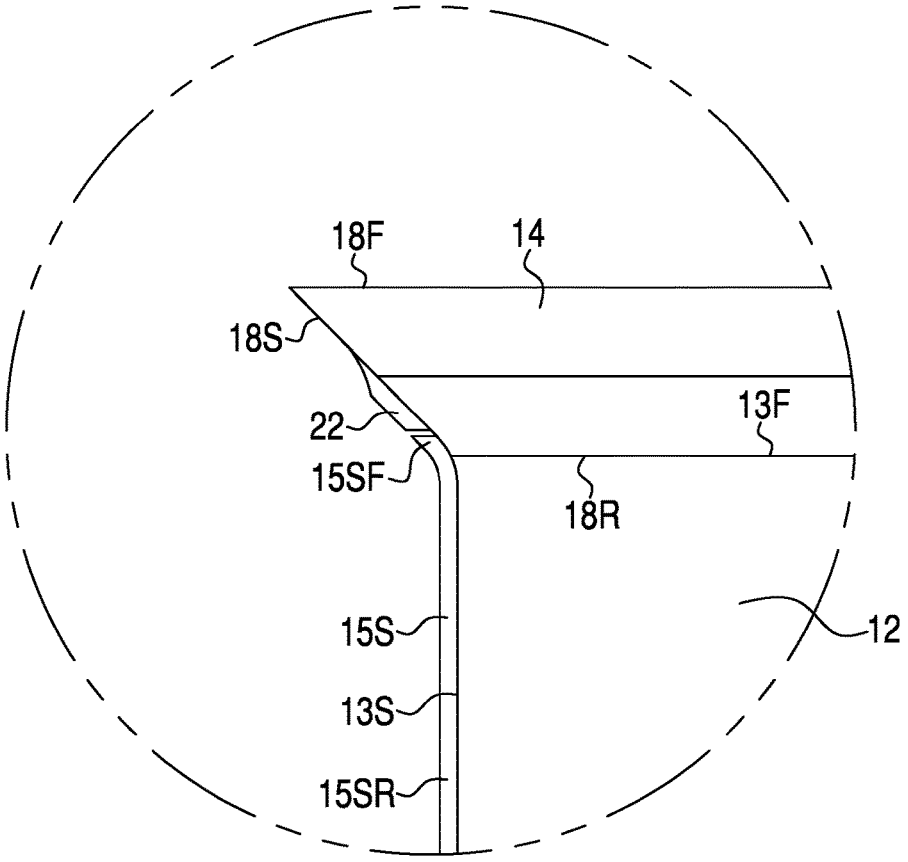
FIG. 23 is an enlarged view of a fragment of the front nosing attached to the stair tread plate shown in the circle "23" in FIG. 22.

Next, the front nosing 12 is attached centrally to the front edge surface 13F of the stair tread plate 12. Specifically, the rear edge surface 18R of the front nosing 14 is fitted flush against the front edge surface 13F of the stair tread plate 12 so that the front tongue 15F of the stair tread plate 12 is snugly inserted into the complementary rear groove 20 of the front nosing 14, as best shown in FIGS. 22 and 23. Preferably, a suitable adhesive is used to secure the front nosing to the tread plate tongue. Accordingly, the force of a person stepping on the nosing is resisted both by the tongue and groove connection and the adhesive, thus assuring that the nosing remains attached to the tread plate.

Then, the side edge surface(s) 13S of the stair tread plate 12 and the side edge surface(s) 18S of the front nosing 14, attached to each other, are machined so as to form, such as by machining, the side tongue(s) 15S and the front nosing tongue(s) 22 thereon. Specifically, the side tongue(s) 15S is formed along the side edge surface(s) 13S of the stair tread plate 12, while the front nosing tongue(s) 22 is formed along a portion but not the entire length the side edge surface(s) 18S of the front nosing 14, as best shown in FIGS. 22 and 23. Moreover, the front nosing tongue(s) 22 is formed so that the front nosing tongue 22 is spaced from the forward end 19F of the side edge surface 18S and from the rearward end 19R of the side edge surface 18S of the front nosing 14, as best shown in FIG. 14.

After that, the return nosing 16 is mounted to the front nosing 14 and the stair tread plate 12 by inserting the front nosing tongue 22 of the front nosing 14 into the forward portion 30F of the side groove 26 of the return nosing 16 and by inserting the side tongue 15S of the stair tread plate 12 into the rearward portion 30R of the side groove 26 and partially into the forward portion 30F of the side groove 26 behind the front nosing tongue 22 of the front nosing 14 and flush against the side edge surface 18S of the front nosing 14 and against the side edge surface 13S of the stair tread plate 12 to form the exposed joint 36 between the side edge surface 18S of the front nosing 14 and the front portion 24F of the inner surface 24 of the return nosing 16. Specifically, the contoured front portion 15SF of the side tongues 15S is disposed in the forward portion 30F of the side groove 26, while the straight rear portion 15SR is disposed in the rearward portion 30R of the side groove 26. The side tongue 15S of the stair tread plate 12 and the rearward portion 30R of the side groove 26 of the return nosing 16 are slidably connected to one another along at least rear portions thereof rearward of the exposed joint 36.

Furthermore, the return nosing 16 is secured to the front nosing 14 and the stair tread plate 12 only along a region including the exposed joint 36 to prevent significant gapping or other deformation of the exposed joint as a result of expansion or contraction of the stair tread plate 12 over a range of ambient temperature and humidity. Specifically, the return nosing 16 is secured to the front nosing 14 by adhesively bonding the return nosing 16 to the front nosing 14 along the exposed joint 36 by a suitable wood glue or other adhesive such as, for example, polyvinyl acetate. Alternatively, the return nosing 16 may be secured to the front nosing 14 by fastening the return nosing 16 to the stair tread plate 12 with a single mechanical fastener, such as a nail 38 or a screw, at a position rearward of the exposed joint 36. Further alternatively, the return nosing 16 may be secured to the front nosing 14 by adhesively bonding the return nosing 16 to the front nosing 14 along the exposed joint 36, then fastening the stair tread plate 12 to the return nosing 16 with a single mechanical fastener 38, such as a nail or a screw, at a position rearward of the exposed joint 36.

Also, because the stair tread plate 12 has a thickness of about ⅝-¾ inches, the fit between the side tongue 15S and the side groove 26 should be accurate in order to assure proper fit and adequate strength, particularly when a person steps onto one of the return nosings 16 and creates a bending moment about the side tongue 15S. The side tongue 15S is centrally located between an upper surface 12T and a lower surface 12B of the stair tread plate 12, best shown in FIGS. 7 and 8. The side tongue 15S is about one third of the thickness of the stair tread plate 12, with exposed tread portions of the side edge surface 13S above and below the side tongue 15S also being about one third of the thickness of the stair tread plate 12.

In tests of the tread plates 12 and the return nosings 16 according to the present invention, the tread plate 12 and the return nosings 16 were joined immediately after having been kiln dried to about seven percent moisture content and increased their moisture content to about fifteen percent with no visible gap or deformation occurring in the shaped joint. Because the tread plates 12 and return nosings 16 were joined after being kiln dried to about seven percent moisture content, and since they will usually not absorb more than about 12-13% moisture while stored in a non-air conditioned warehouse in mid to late summer, the tests are believed to cover more than the full range of moisture conditions to which such materials will ordinarily be subjected. In the exemplary embodiment, as previously explained, while it is preferable to secure the return nosing 16 to the stair tread plate 12 by both gluing the opposing surfaces of the exposed joint 36 together and by fastening the return nosing 16 to the stair tread plate 12 with a suitable mechanical fastener such as a nail, screw, wooden dowel pin or the like, the exposed joint 36 can be adequately secured by gluing the exposed joint 36 without using a mechanical fastener or by using a mechanical fastener as shown in the examples without gluing the exposed joint.

The present invention is particularly suited for reconditioning existing stairways. Many stairways are manufactured with treads and landings made of oriented strand board ("OSB") or similar wood composite, where the treads and landings are carpeted (i.e., carpet covered) and not normally visible and the homeowner does not see the poor surface quality of the underlying composite. Many homeowners seek to upgrade their stairways but do not want to incur the cost of entirely replacing the existing stairway, which is an expensive and time-consuming project. The returned stair treads of the present invention are relatively thin, on the order of about ⅝-¾ inches thickness, in order to be overlaid or retrofit onto the existing treads and landings of a stairway. As a result, the finished stairway resembles a high-quality wood stairway. The ⅝-¾ inches returned stair tread assembly disclosed herein allows a consumer to keep the same elevation with flooring that had been carpeted because it normally is ⅝-¾ inches as well. As illustrated in FIG. 2, the returned stair tread assemblies 10 of the present invention made of high-quality solid wood are overlaid on existing treads 8 made of wood composite OSB or other inexpensive material having poor surface quality.

The foregoing description of the exemplary embodiment of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. A returned stair tread assembly for use on an open portion of a stairway, the returned stair tread assembly comprising:

a stair tread plate made of solid wood and having a front edge surface and a side edge surface;

a front nosing made of solid wood and having a front edge surface, a rear edge surface and a side edge surface, the rear edge surface of the front nosing fitted flush against the front edge surface of the stair tread plate;

a return nosing made of solid wood and fitted flush against the side edge surface of the stair tread plate and the front nosing so as to form an exposed joint between the front nosing and the return nosing along the side edge surface of the front nosing and a front portion of the return nosing; and a securing device securing the return nosing to the front nosing and the stair tread plate only in a region including the exposed joint;

the stair tread plate having a side tongue formed along the side edge surface of the stair tread plate;

the front nosing having a front nosing tongue formed along a portion of the side edge surface of the front nosing;

the return nosing having a side groove formed along a portion of an inner surface of the return nosing and receiving the front nosing tongue of the front nosing and the side tongue of the stair tread plate;

the front nosing tongue and the side tongue disposed in the side groove and slidably connect the stair tread plate and the return nosing along at least rear portions of the return nosing;

the front nosing tongue spaced from forward and rearward ends of the side edge surface of the front nosing.

2. The returned stair tread assembly as defined in claim 1, wherein a front end of the side groove is spaced from a forward end of the return nosing.

3. The returned stair tread assembly as defined in claim 2, wherein a rear end of the side groove is spaced from the rearward end of the return nosing.

4. The returned stair tread assembly as defined in claim 1, wherein the securing device comprises an adhesive applied between adjoining surfaces of the exposed joint.

5. The returned stair tread assembly as defined in claim 4, wherein the adhesive is a wood glue.

6. The returned stair tread assembly as defined in claim 4, wherein the securing device comprises a mechanical fastener.

7. The returned stair tread assembly as defined in claim 1, wherein the securing device comprises a mechanical fastener.

8. The returned stair tread assembly as defined in claim 7, wherein the exposed joint further comprises an adhesive applied between adjoining surfaces of the exposed joint, and wherein the adhesive does not extend rearwardly beyond the mechanical fastener.

9. The returned stair tread assembly as defined in claim 6, wherein the mechanical fastener is positioned rearwardly of the exposed joint.

10. The returned stair tread assembly as defined in claim 6, wherein the mechanical fastener is one of a nail, a dowel, and a screw.

11. The returned stair tread assembly as defined in claim 6, wherein the mechanical fastener is rearward of the exposed joint.

12. The returned stair tread assembly as defined in claim 1, wherein a rear end of the side groove of the return nosing is spaced from the rear edge surface of the stair tread plate.

13. The returned stair tread assembly as defined in claim 1, wherein the stair tread plate, the front nosing and the return nosing are made of wood.

14. The returned stair tread assembly as defined in claim 1, wherein the stair tread plate has a front tongue formed along the front edge surface of the stair tread plate, wherein the front nosing has a rear groove formed along the rear edge surface of the front nosing, and wherein the front tongue of the stair tread plate is disposed in the rear groove of the front nosing.

15. A method for making a returned stair tread assembly for use on an open stairway or an open portion of a stairway, the method comprising the steps of:

providing a stair tread plate made of solid wood and having a front edge surface and a side edge surface;

providing a front nosing made of solid wood and formed separately from the stair tread plate and having a front edge surface, a rear edge surface and a side edge surface, the front nosing having a rear groove formed along the rear edge surface of the front nosing;

providing a return nosing made of solid wood and having a side groove formed along a portion but not an entire length of an inner surface of the return nosing, a front end of the side groove spaced from a forward end of the return nosing, the side groove having a forward portion formed in a front portion of the inner surface of the return nosing and a rearward portion formed in a rear portion of the inner surface of the return nosing;

forming a side tongue along the side edge surface of the stair tread plate and a front nosing tongue along a portion but not the entire length the side edge surface of the front nosing so that the front nosing tongue is spaced from forward and rearward ends of the side edge surface of the front nosing;

attaching the front nosing to the stair tread plate so that the rear edge surface of the front nosing fitting flush against the front edge surface of the stair tread plate;

mounting the return nosing to the front nosing and the stair tread plate by inserting the front nosing tongue of the front nosing into the forward portion of the side groove of the return nosing and the side tongue of the stair tread plate into the rearward portion of the side groove of the return nosing to form an exposed joint between the side edge surface of the front nosing and the front portion of the inner surface of the return nosing, the side tongue of the stair tread plate and the rearward portion of the side groove of the return nosing slidably connected to one another along at least rear portions thereof rearward of the exposed joint; and securing the return nosing to the front nosing and the stair tread plate only along a region including the exposed joint to prevent gapping or other deformation of the exposed joint as the result of expansion or contraction of the stair tread plate over a range of ambient temperature and humidity.

16. The method as defined in claim 15, wherein the step of securing comprises fastening the return nosing to the stair tread plate with a mechanical fastener at a position rearward of the exposed joint.

17. The method as defined in claim 15, wherein the step of securing comprises adhesively bonding the return nosing to the front nosing along the exposed joint.

18. The method as defined in claim 15, wherein the step of securing further comprises the steps of:

adhesively bonding the return nosing to the front nosing along the exposed joint; and fastening the stair tread plate to the return nosing with a mechanical fastener at a position rearward of the exposed joint.

19. A staircase, comprising:

at least a first side stringer having a plurality of horizontal tread receiving surfaces;

a plurality of returned tread assemblies, each returned tread assembly having a moisture compensating joint, wherein each returned tread assembly comprises:

a stair tread plate made of solid wood and having a front edge surface and a side edge surface;

a front nosing made of solid wood and having a front edge surface, a rear edge surface and a side edge surface, the rear edge surface of the front nosing fitted flush against the front edge surface of the stair tread plate;

a return nosing made of solid wood and fitted flush against the side edge surface of the stair tread plate and the front nosing so as to form an exposed joint between the front nosing and the return nosing along the side edge surface of the front nosing and a front portion of the return nosing; and a securing device securing the return nosing to the front nosing and the stair tread plate only in a region including the exposed joint;

the stair tread plate having a side tongue formed along the side edge surface of the stair tread plate;

the front nosing having a front nosing tongue formed along a portion of the side edge surface of the front nosing so as to be spaced from forward and rearward ends of the side edge surface of the front nosing;

the return nosing having a side groove formed along a portion of an inner surface of the return nosing and receiving the front nosing tongue of the front nosing and the side tongue of the stair tread plate;

the front nosing tongue and the side tongue disposed in the side groove and slidably connect the stair tread plate and the return nosing along at least rear portions of the return nosing.

* * * * *